United States Patent [19]

Kato et al.

[11] Patent Number: 5,067,235

[45] Date of Patent: Nov. 26, 1991

[54] METHOD FOR JOINING HEAT EXCHANGER TUBES WITH HEADERS

[75] Inventors: Hisataka Kato; Satoshi Takahashi, both of Hadano, Japan

[73] Assignee: Toyo Radiator Co., Ltd., Tokyo, Japan

[21] Appl. No.: 519,534

[22] Filed: May 4, 1990

[51] Int. Cl.[5] ..... B21D 53/06

[52] U.S. Cl. ..... 29/890.043; 29/512; 29/890.052; 228/183

[58] Field of Search ..... 29/890.044, 890.043, 29/890.052, 890.03, 511, 512; 165/173, 175; 228/183, 184

[56] References Cited

U.S. PATENT DOCUMENTS

| | | | |
|---|---|---|---|
| 3,708,012 | 1/1973 | Zimprich | 29/890.043 |
| 3,940,837 | 3/1976 | Wiese | 29/890.044 |
| 4,150,556 | 4/1979 | Melnyk | 29/890.043 |
| 4,234,041 | 11/1980 | Melnyk | 29/890.052 |
| 4,272,006 | 6/1981 | Kao | 29/890.043 |
| 4,500,030 | 2/1985 | Gerber et al. | 29/890.043 |
| 4,730,669 | 3/1988 | Beasley et al. | 29/890.043 |
| 4,744,505 | 5/1988 | Calleson | 29/890.044 |
| 4,813,112 | 3/1989 | Pilliez | 29/890.043 |

*Primary Examiner*—Irene Cuda

*Attorney, Agent, or Firm*—Sughrue,Mion,Zinn,Macpeak & Seas

[57] ABSTRACT

In a method for joining a plurality of heat exchanger flat tubes with headers of a heat exchanger: each of the opposite end portions of the flat tubes has a cross section provided with a major axis and a minor axis; opposite major axis side walls of the cross section of each of opposite end portions of each of the flat tubes are obliquely cut off so as to form each of opposite minor axis side walls of the cross section of the end portion of the flat tube into a trapezoidal shape; the end portion of the flat tube is passed through an elliptical hole formed in the header; the end portion of the flat tubes thus passed through the header is flared over its entire peripheral wall; the thus flared end portion of the flat tube is then bent so as to be formed into a bent portion of the flat tube, which bent portion constitutes an essential part of a joint formed between the flat tube and the header; and the thus formed joint is dipped into a molten filler metal bath to form brazed or soldered portions around the joint.

7 Claims, 3 Drawing Sheets

METHOD FOR JOINING HEAT EXCHANGER TUBES WITH HEADERS

BACKGROUND OF THE INVENTION

1. Field of the Invention

The present invention relates to a method for joining heat exchanger tubes with headers, and more particularly to a method for joining a plurality of flat tubes with heaters in an heat exchanger.

2. Description of the Prior Art

In general, any type of vehicles is provided with an engine cooling system having a heat exchanger for cooling its engine during operation. In the engine cooling system of the vehicle, a cooling liquid such as cooling water is heated by the engine, and then supplied to the heat exchanger through conduits. In the heat exchanger, the thus heated cooling liquid gives its heat to open air through walls of the heat exchanger to permit the open air to cool the cooling liquid. The thus cooled cooling liquid is then returned to the engine through the conduits.

The heat exchanger or radiator is generally constructed of: a pair of cooling liquid tanks spaced apart from each other; and a plurality of tubes interposed therebetween and arrange parallel to each other. More particularly, in the heat exchanger, a pair of headers spaced apart from each other are employed. Each of the headers constitutes a part of each of the tanks, and is connected to each of opposite ends of the tubes which are interposed between the tanks and arranged parallel to each other therebetween. In construction of the tank, the tank is, for example, assembled from two parts one of which is the header and the other of which is a tank body assuming a pan-shaped form. In this case, a flange is formed in an opening portion of the tank body, and a peripheral portion of the header is hermetically connected to the flange of the tank body. On the other hand, the header is provided with a plurality of holes each of which an end portion of each of the heat exchanger tubes passes through to join the tubes and the header, and the tubes are hermetically connected to the header at joints therebetween. In case that the heat exchanger or radiator is of a tube-and-fin type, such heat exchanger consists of the tubes and a plurality of air fins placed around the tubes to improve heat transfer. In operation of the engine, a hot cooling water flows out of water jackets of the engine, and enter one of the tanks of the heat exchanger. Then, the cooling water flows to the tubes through which the cooling water enters the other of the tanks of the heat exchanger. In the above process, the hot cooling water is cooled by open air while passed through the tubes. The cooling water having been cooled and received in the other of the tanks returns to the water jackets of the engine. In some heat exchangers with the above construction, the cooling water leaks from the joints between the tubes and the headers. In general, outer peripheral surfaces of the tubes and peripheral portions of the holes of the headers adjacent to the outer peripheral surfaces of the tubes are brazed or soldered to each other to constitute liquid-tight joints between the tubes and the headers. In service life, the heat exchanger is heated during use of the engine while cooled during non-use of the engine. Namely, the heat exchanger is subjected to heat cycles in its service life to suffer from thermal stresses caused by differences in thermal expansion and contraction between materials of the tubes and the headers.

Such thermal stresses appearing in the materials of the tubes and the headers are concentrated on the joints, and often cause fatigue failures of the joints.

Heavy construction machines generally employ large-sized heat exchangers for cooling their engines in operation. Such large-sized heat exchangers are very heavy since they contain ample amounts of cooling water. The large-sized heat exchanger employs flat tubes as its constituent element, which flat tubes are supported by metal plates or headers each of which is made of brass and has a thickness of about 3 to about 7 mm. Thermal stresses appearing in joints between the headers and the flat tubes of the large-sized heat exchanger are considerably large in comparison with those appearing in ordinary-sized heat exchangers. These thermal stresses are produced by thermal expansion and contraction of the materials of the heat exchanger. In addition to the thermal stresses, the large-sized heat exchanger suffers from mechanical stresses resulted from its heavy weight. In order to withstand these thermal stresses and mechanical stresses, the joints between the tubes and the headers must have sufficient strength.

In the heat exchanger provided with the flat tubes, the joints between the flat tubes and the headers is increased in strength according to a method for increasing strength of joints between headers and flat tubes, which method is disclosed in Japanese Patent Laid-Open No. Hei 1-281399. According to the method disclosed in the Japanese Patent Laid-Open No. Hei 1-281399: end portions of the flat tubes are passed through elliptical holes formed in the headers; opposite minor axis side walls of each of the end portions of the flat tubes are cut by a cutter and bent radially outwardly at right angles; and the thus radially outwardly bent wall portions of the flat tubes are brazed or soldered to the headers to form the joints therebetween. However, in this method, since only the minor axis side walls of the flat tubes are bent, four notches are inevitably formed in each end wall portion of each of the flat tubes, which notches appear at positions between the thus cut minor axis walls and major axis walls separated from such minor axis walls of the flat tubes. Consequently, axial loads acting on the flat tubes act in turn to the joints thereof to produce concentrated stresses at the notches of the joints. Therefore, the above conventional method fails to provide the joints with sufficient strength. In addition, the joints formed according to the conventional method produce turbulent flow of the cooling water in operation to considerably increase flow passage resistance of the heat exchanger. These are problems inherent in the conventional method.

SUMMARY OF THE INVENTION

Under such circumstances, it is an object of the present invention to provide a method for joining heat exchanger tubes with headers of a heat exchanger through joints having sufficient strength and preventing turbulent flow of cooling liquid in passages of the heat exchanger.

It is another object of the present invention to provide a method for joining flat tubes with headers of a large-sized heat exchanger having a weight of several kilograms.

The above objects of the present invention may be accomplished by providing:

A method for joining heat exchanger tubes with headers of a heat exchanger, wherein each tubes comprises a flat tube through which a cooling liquid flows and each header is provided with a plurality of elliptical holes through which the header is joined with the tubes to form liquid-tight joints therebetween. A peripheral portion of the header is joined with a flange portion of a tank body to form a tank for receiving the cooling liquid therein, The method includes the steps of:

forming each of opposite minor axis side walls of each of opposite end portions of each of the flat tubes into trapezoidal shape by obliquely cutting opposite major axis side walls of each of opposite end portions of each of the flat tubes;

passing each of opposite end portions of each of the flat tubes through each of the elliptical holes of each of the headers;

flaring the each of opposite end portions of each of the flat tubes;

bending radially outwardly an entire wall of the thus flared each of the opposite end portions of the flat tubes to form a bent portion which abuts on each of the headers and has a relatively small width in a direction parallel to the major axis of each of the flat tubes and a relatively large width in a direction parallel to the minor axis of each of the flat tubes; and brazing or soldering: the bent portion of each of the flat tubes to each of the headers; and the flat tubes to the headers.

The above objects, additional objects, features and advantages of the present invention will be clarified hereinbelow with reference to the following description and accompanying drawings illustrating preferred embodiments of the present invention.

DESCRIPTION OF THE PREFERRED EMBODIMENTS

Figure 1:
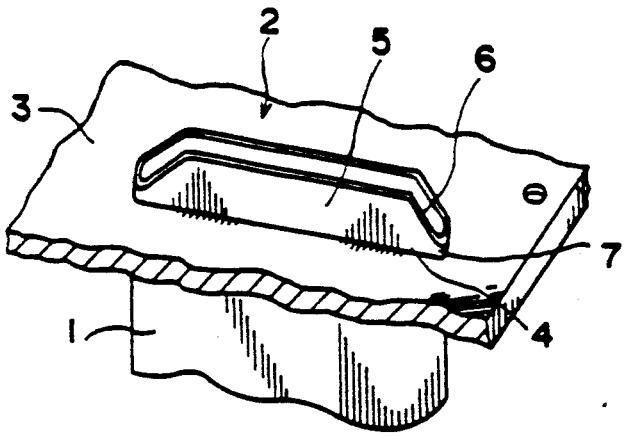
FIGS. 1 and 1A are perspective views of an essential part of the joints between the flat tube and the header, illustrating the step of passing each of opposite end portions of each of the flat tubes through each of the elliptical holes of each of the headers according to the method of the present invention.

The, embodiments of the present invention will be described in detail hereafter with reference to the accompanying drawings.

The method of the present invention for joining heat exchanger tubes 1 with headers 3 may be applied to a heat exchanger 90 (shown in FIG. 12) of a type constructed of: a pair of cooing liquid tanks 91, 92 (shown in FIG. 12) spaced apart from each other, each of the tanks 91, 92 being assembled from a plate-like header 3 and a pan-like tank body 21; and a plurality of flat tubes 1 interposed between these tanks 91, 92 to communicate the tanks 91, 92 with each other. In the heat exchanger 90 having the above construction, each of the tanks 91, 92 is constructed of metal plates. On the other hand, the flat tubes 1 are made of suitable metals having good heat transfer properties such as brass, aluminum, copper and like metals. In the heat exchanger or radiator 90, preferably, air fins 95 (shown in FIG. 12) are made of the same material as that of the flat tubes 1, and placed around the flat tubes 1.

A plurality of elliptical holes 4 is formed in the header 3 of the heat exchanger 90 in rows. Each of the elliptical holes 4 is similar in shape and size to a cross section of the flat tube 1, and may be slightly larger in size than the cross section of the flat tube 1. The header 3 is preferably made of the same material as that of the flat tube 1.

The method of the present invention is advantageously applied to large-sized heat exchangers 90, for example such as one employed in a cooling system of a 200 horsepower engine for a construction machine, a capacity of the heat exchanger 90 being within a range of from about 100,000 to about 130,000 Kcal/hr, in which heat exchanger 90 are employed: a plurality of the flat tubes 1 each of which has an elliptical cross section having a major axis of 14 mm and a minor axis of 2.5 mm, and has an axial length of from 800 to 1500 mm, the number of the flat tubes 1 being within a range of from 400 to 500; a plurality of the air fins 95 placed around the flat tubes 1; and a pair of headers 3 spaced apart from each other to interpose the flat tubes 1 and the air fins 95 therebetween, each of which headers 3 has a thickness of approximately 5 mm and is made of brass.

With respect to the brazing or soldering operation of joints between the flat tubes 1 and the headers 3 of the heat exchanger 90, conventional brazing and soldering techniques may be employed to braze or solder the flat tubes 1 to the headers 3 with the use of conventional filler metals. For example, the joints formed between the flat tubes 1 and the headers 3 are dipped in a molten filler metal bath to braze or solder the flat tubes 1 to the headers 3.

Now, with reference to the drawings, embodiments of a method of the present invention for joining heat exchanger tubes with headers of a heat exchanger will be described.

In FIGS. 1, 1A, 2 and 3, there are sequentially shown essential steps of the method of the present invention for joining the flat tubes 1 with the headers 3. In the method of the present invention:

In a first step, as shown in FIG. 1, each of opposite minor axis side walls 5 of each of opposite end portions of each of the flat tubes 1 is formed into trapezoidal shape by obliquely cutting opposite major axis side walls 6 of each of opposite end portions of each of the flat tubes 1. As for the trapezoidal shape, it is possible to adequately determine its size and contour according to desired requirements of the heat exchanger 90. For example, in the above-mentioned large-sized heat exchanger having a capacity of from about 100,000 to about 130,000 Kcal/hr: a length of the major axis of the cross section of the flat tube 1 is of from 2 to 4 mm; an axial length of each of the opposite end portions of the flat tube 1, which end portions have passed through the elliptical hole 4 of the header 3, is the same as the length of the major axis of the cross section of the flat tube 1; and a ratio of the length of the major axis (of the cross section of the flat tube 1) to a length of a top edge of the trapezoidal shape is preferably within a range of from 10/4 to 10/7.

Incidentally, in the embodiment of the trapezoidal shape shown in FIG. 1, the opposite major axis side walls 6 of the flat tube 1 is obliquely cut to form straight slopes.

Figure 1A:
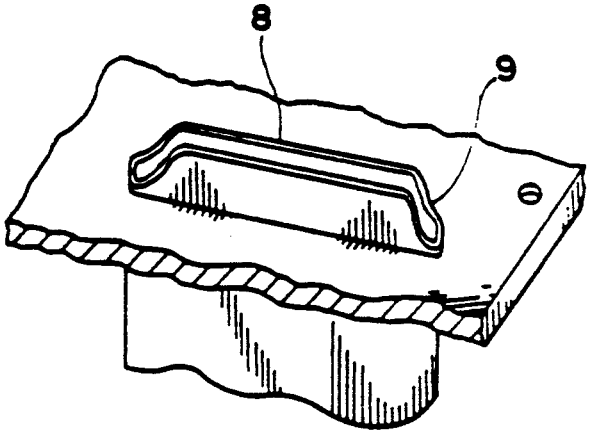

FIG. 1A shows another embodiment of the trapezoidal shape 8. In this another embodiment, the opposite major axis side walls 6 of the flat tube 1 is obliquely cut to form concave slopes 9.

In a second step of the method of the present invention following the above first step of forming each of the axial opposite ends of the flat tube 1 into the trapezoidal shape, as shown in FIG. 1, the axial end portion 2 of the flat tube 1 is inserted into one of the plurality of elliptical holes 4 formed in the header 3 to pass through the header 3 by a predetermined length. In the embodiment of the flat tube 1 shown in FIG. 1, the flat tube 1 has a cross section having: a major axis of 14 mm; and a minor axis of 2.5 mm, is made of brass and has a thickness of 0.2 mm.

Figure 2:
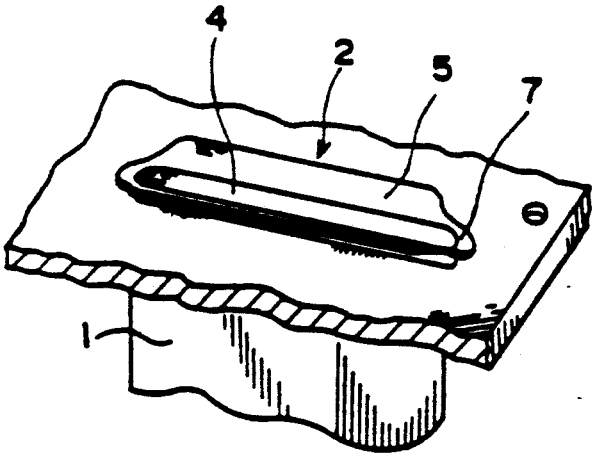
FIG. 2 is a perspective view of an essential part of the joint between the flat tube and the header, illustrating the step of having the each of opposite end portions of each of the flat tubes flared according to the method of the present invention.

In a third step of the method of the present invention, as shown in FIG. 2, each of opposite end portions 2 of the flat tube 1 is flared so that both of the major axis side walls 7 and the minor axis side walls 5 are radially outwardly extended.

Figure 4:
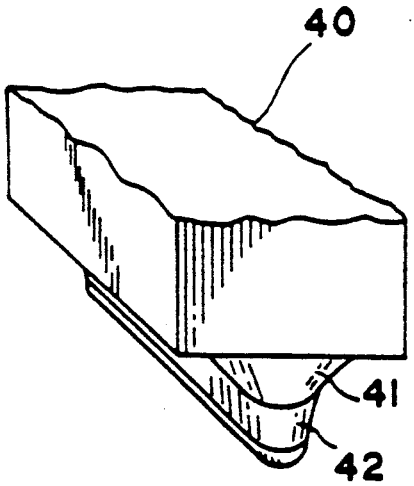
FIG. 4 is a perspective view of an essential part of a flaring tool employed in the step of having the each of opposite end portions of each of the flat tubes flared according to the method of the present invention.

The third step of the method of the present invention may be accomplished by the use of a flaring tool 40 shown in FIG. 4. In the third step, the flaring tool 40 is forcibly inserted into the end portion 2 of the flat tube 2 to flare the portion 2 so that each of the major axis side walls 7 and the minor axis side walls 5 is radially outwardly extended in a direction deviated from a longitudinal axis of the flat tube 1 by an angle of, preferably from about 20° to about 60°. Incidentally, as shown in FIG. 4, the flaring tool 40 is provided with a second tapered portion 42 to facilitate insertion of the flaring tool 40 into the end portion 2 of the flat tube 1. The end portion 2 of the flat tube 1 is partially or fully flared by tapered surfaces of the flaring tool 40.

Flaring operation is sequentially conducted on each of the end portions 2 of the flat tubes 1 after completion of assembling of the core of the heat exchanger 90. The core of the heat exchanger 90 is assembled from: a plurality of the air fins 95 spaced apart from and in parallel to each other, each of which fins 95 is provided with a plurality of elliptical fin holes for receiving the flat tubes 1 therein while made of suitable metals such as brass and the like; and a plurality of the flat tubes 1 passed through the elliptical fin holes of the air fins 95, the elliptical fin holes of any one of the air fins 95 being aligned with the elliptical fin holes of adjacent air fins 95. After completion of assembling of the core of the heat exchanger 90, the opposite end portions 2 of the flat tubes 1 of the core are passed through the headers 3 to permit the end portions 2 to extend from the headers 3 by a length of about from 3 to about 6 mm to construct a core assembly which is then held upright on a suitable supporting structure. In such upright position, the core assembly is subjected to the flaring operation of the end portions 2 of the flat tubes 1, in which operation upper end portions 2 of the flat tubes 1 are individually flared. The flaring tool 40 may be of a reciprocating type or of a rotary type as shown in FIG. 5A in which the flaring tool 40 is provided with a plurality of tooth-like flaring means in its outer peripheral surface at equal angular intervals. In operation, the rotary type flaring tool 40 rolls on the header 3 of the core assembly to permit its tooth-like flaring means to forcibly enter the upper end portions 2 of the flat tubes 1 mounted in the header 3, so that each of the tooth-like flaring means presses each of the upper end portions 2 of the flat tubes 1 into a flared shape.

A lower side of the core assembly of the heat exchanger is also subjected to the flaring operation in the same manner as that conducted in the upper side of the core assembly.

Figure 3:
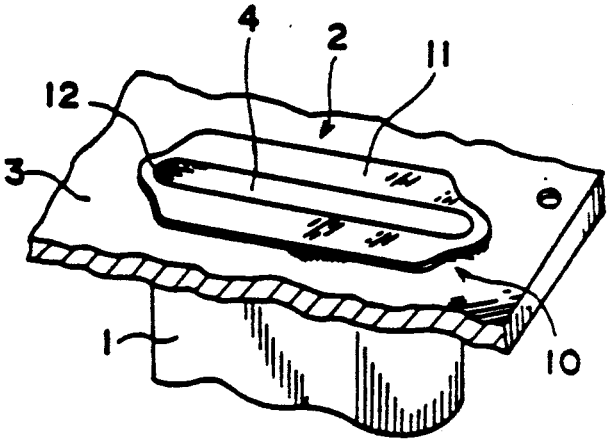
FIG. 3 is a perspective views of an essential part of the joint between the flat tube and the header, illustrating the step of bending radially outwardly an entire wall of each of the opposite end portions of the flat tubes to form a bent portion which abuts on each of the headers and has a relatively small width in a direction parallel to the major axis of each of the flat tubes and a relatively large width in a direction parallel to the minor axis of each of the flat tubes according to the method of the present invention.

In a fourth step of the method of the present invention following the above third step, as shown in FIG. 3, an entire wall of the thus flared each of the opposite end portions 2 of the flat tubes 1 is bent radially outwardly to form a bent portion 10 which abuts on the header 3 and has a relatively small width part 12 in a direction parallel to the major axis of the cross section of the flat tube 1 and a relatively large width part 11 in a direction parallel to the minor axis of the cross section of the flat tube 1. The relatively large width part 11 and the relatively small width part 12 of the bent portion 10 of the flat tube 1 correspond to the major axis side walls 5 and the major axis side walls 7 of the flat tube 1, respectively. In case that the flat tubes 1, each of which has a thickness of 0.2 mm and is provided with a cross section having a major axis of 14 mm and a minor axis of 2.5 mm while made of brass, are employed in the heat exchanger 90, it is preferable that each of the relatively small width part 12 and the relatively large width part 11 of the bent portion 10 of the flat tube 1 has the following size: namely, a width of the relatively large width part 11 is within a range of about 2 to about 6 mm, preferably within a range of about 2.5 to about 3 mm; and a width of the relatively small width part 12 is within a range of from 1 to 3 mm, preferably within a range of from 1 to 1.5 mm.

Figure 5:
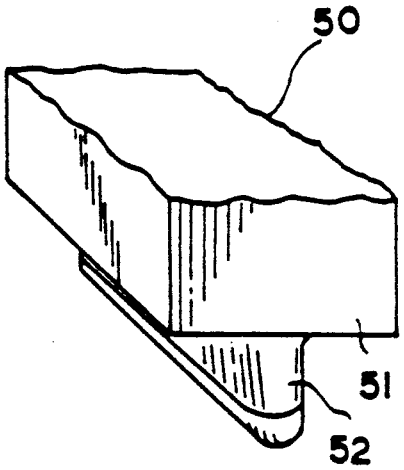
FIG. 5 is a perspective view of an essential part of a bending tool employed in the step of bending radially outwardly the entire wall of the thus flared each of the opposite end portions of the flat tubes to form a bent portion which abuts on each of the headers and has a relatively small width in a direction parallel to the major axis of each of the flat tubes and a relatively large width in a direction parallel to the minor axis of each of the flat tubes according to the method of the present invention.
Figure 5A:
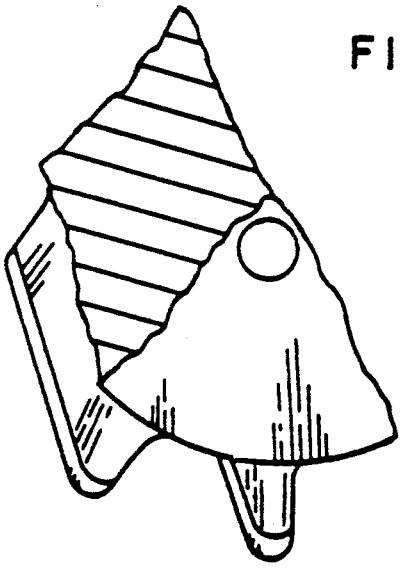
FIG. 5A is a perspective view of an essential part of another embodiment of the bending tool employed in the steps of bending according to the method of the present invention.

The above bending operation of the end portions 2 of the flat tubes 1 is conducted by the use of a bending tool, for example such as one 50 shown in FIG. 5. During the bending operation: the end portion 20 of the flat tube 1 is pressed by a flat shoulder surface 51 of the bending tool 50 to form the bent portion 10 of the flat tube 1, as shown in FIG. 3; and, at this time, a protruding portion 52 of the bending tool 50 is inserted into the end portion 2 of the flat tube 1 to expand a diameter of the flat tube 1 by a predetermined amount so that the flat tube 1 is press-fitted to the elliptical hole 4 of the header 3. Incidentally, in case that the flat tube 1 can be press-fitted to the elliptical hole 4 of the header 3 during the flaring operation of the end portion 2 of the flat tube 1, it is possible to eliminate such expanding operation of the end portion 2 of the flat tube 1.

It is possible to employ a conventional press machine as a means for driving the bending tool 50 in the bending operation of the end portion 2 of the flat tube 1. Further, in the bending operation, it is also possible to employ a bending tool having a construction similar to that of the rotary type flaring tool shown in FIG. 5A. In addition to the above, it is also possible to bend a plurality of the end portions 2 of the flat tubes 1 at the same bending stroke of the bending operation.

As shown in FIG. 3, in case that the bent portion 10 of the flat tube 1 is formed to extend in a direction perpendicular to a longitudinal axis of the flat tube 1, there is substantially no fear that cracks occur in the bent portion 10, because: an axial length of the major axis side wall 7 of the end portion 2 of the flat tube 1, which wall 7 being hard to be plastically deformed, is short; and boundary portions between the major axis side walls 7 and the minor axis side walls 5 constitute gentle slopes so as to eliminate the notches appearing in the boundary portions formed according to the conventional method.

As shown in FIG. 3, according to the method of the present invention, it is possible to form the bent portion 10 assuming an annular shape substantially without producing cracks. Consequently, it is possible to evenly distribute an axial load of the flat tube 1 over the bent portion 10 or joint formed between the flat tube 1 and the header 3, so that there is no fear that concentrated stresses appear as is in the joint formed according to the conventional method. As a result, the bent portion 10 or joint formed between the flat tube 1 and the header 3 according to the method of the present invention can stand large stresses which the joint formed according to the conventional method can not stand. In addition, since the minor axis side wall 5 has a relatively large width, the bent portion 10 or joint formed between the flat tube 1 and the header 3 can support a large axial load which the conventional joint can not support.

Figure 6:
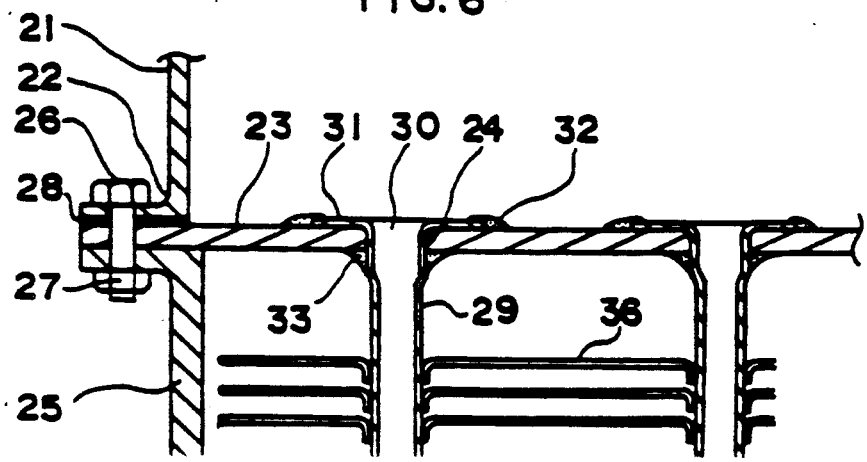
FIG. 6 is a longitudinal sectional view of an essential part of a core of the heat exchanger, illustrating the joints formed between the flat tubes and the header of the heat exchanger according to the method of the present invention.
Figure 7:
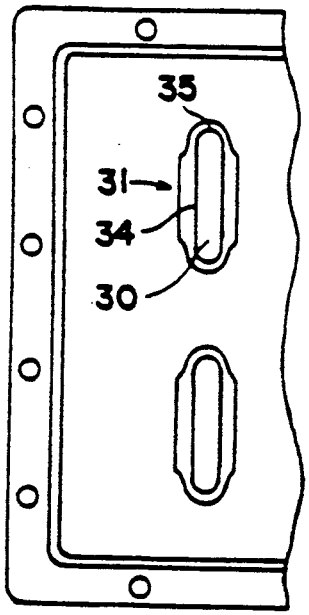
FIG. 7 is a plan view of an essential part of the core of the heat exchanger which is shown in FIG. 6 and constructed according to the method of the present invention.

After completion of formation of the bent portion 10 of the flat tube 1 as shown in FIG. 3, a fifth step of the present invention is conducted. In the fifth step, a brazing or soldering operation is conducted to braze or solder: the bent portion 10 of the flat tube 1 to the header 3; and the flat tube 1 to the header 1. An example of a brazing or soldering operation is conducted by dipping the bent potion 10 or joint formed between the flat tube 1 and the header 3 into a molten filler metal bath. FIG. 6 shows an essential part of a construction of the thus brazed or soldered joint formed between the flat tube 1 and the header 3 according to the method of the present invention. FIG. 7 is a plan view of the essential part of the construction of the thus brazed or soldered joint shown in FIG. 6.

As is clear from FIGS. 6 and 7, the tank body 21 assumes a pan-like shape having an opening defined by a flange portion 22 of the tank body 21. In a construction of the heat exchanger shown in FIG. 6, the header 23 is provided with a plurality of elliptical holes 24, and has its outer peripheral portion abut on the flange portion 22 of the tank body 21 so that the outer peripheral portion of the header 23 is clamped between the flange portion 22 of the tank body 21 and another flange portion of a side member 25 oppositely disposed from the tank body 21 by fastening bolts 26 and nuts 27, the nuts 27 being able to be replaced with a bar member provided with a plurality of threaded holes which may be threadably engaged with the bolts 26. In the above construction, a packing 28 is interposed between the flange portion 22 of the tank body 21 and the outer peripheral portion of the header 23 to seal therebetween.

As shown in FIG. 6, the end portion 30 of each of the flat tubes 29 is passed through each of the elliptical holes 24 of the header 23, and the entire peripheral wall of the end portion 30 extending from the header 23 is bent to form the bent portion 31 which assumes a flat annular shape abutting on the surface of the header 23 in a manner of area contact. As shown in FIG. 6, the bent portion 31 of the flat tube 29 is brazed or soldered to the header 23 to form brazed or soldered portions 32, 33. In the construction of the heat exchanger shown in FIG. 6, since the bent portion 31 of the flat tube 29 is joined with the header 23 through a wide area, a joint strength of each of the brazed or soldered portions 32, 33 formed between the flat tube 29 and the header 23 is sufficiently large. In addition, a flow resistance of the cooling water passing through the joint or end portion 30 of the flat tube 29 is sufficiently low. As described above, during flaring step of the method of the present invention, the end portion 30 of the flat tube 29 is expanded so as to be press-fitted to the elliptical hole 24 of the header 23. Then, the joint formed between the flat tube 29 and the header 23 is dipped into the molten filler metal bath to form the brazed or soldered portions 32, 33 shown in FIG. 6.

As is clear from FIG. 7 showing the bent portion 31 of the flat tube 29, the major axis side wall 35 of the flat tube 29 is shorter in axial length than the minor axis side wall 34. On the other hand, as shown in FIG. 6, a plurality of the air fins 36 are placed around the flat tubes 29 and brazed or soldered to the outer peripheral surfaces of the flat tubes 29.

Figure 8:
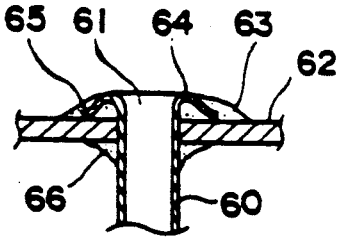
FIG. 8 is a longitudinal sectional view of another embodiment of the joint formed between the flat tube and the header according to the method of the present invention.

FIG. 8 shows an essential part of the joint formed between the flat tube 60 and the header 62 of the heat exchanger constructed according to another embodiment of the method of the present invention. In this embodiment, the end portion 61 of the flat tube 60 is passed through the elliptical hole of the header 62, and then subjected to the flaring and the bending operations to form a convex bent portion 64 of the flat tube 60 to permit its entire outer peripheral edge 63 to abut on the surface of the header 62. It is preferable that the entire edge 63 abuts on the surface of the header 62. However, the edge 63 of the convex bent portion 64 of the flat tube 60 may partially abut on the surface of the header 62. It is also possible for the convex bent portion 64 of the flat tube 60 to assume another convex shape in which: only radially outward edge portions of the minor axis side walls of the flat tube 60 are brought into contact with the surface of the header 62; and the major axis side walls of the flat tube 60 are extended upward in directions deviated from a longitudinal axis of the flat tube so as to be prevented from being brought into contact with the header 60. The above another convex shape of the bent portion 64 can be realized by only employing a bending tool having a contour different from that of the bending tool 50 employed in the above bending step of the method of the present invention. Namely, for example, in the bending tool 50 shown in FIG. 5, by replacing the flat shoulder surface 51 with an annular convex surface a contour of which corresponds to that of the convex bent portion 64 of the flat tube 60.

The joint formed between the flat tube 60 and the header 62 shown in FIG. 8 are dipped into the molten filler metal bath to form the brazed or soldered portions 65, 66 in the same manner as that employed in brazing or soldering the joint formed between the flat tube 29 and the header 23 shown in FIG. 6. Incidentally, an inside convex area defined between the convex bent portion 64 of the flat tube 60 and the surface of the header 62 may be also brazed or soldered in the above dipping manner by the use of the molten filler metal bath. As for the convex bent portion 64 assuming the above another shape, the major axis side walls of the flat tube 60 extending upward in the directions deviated from the longitudinal axis of the flat tube 60 may be also brazed or soldered to the header 62 in the same manner as that employed in brazing or soldering the joint formed between the flat tube 29 and the header 23 shown in FIG. 6, to improve the thus brazed joint in strength.

As is clear from FIG. 8, a flow resistance of the cooling liquid passing through the end portion 61 of the flat tube 60 is sufficiently low.

Figure 9:
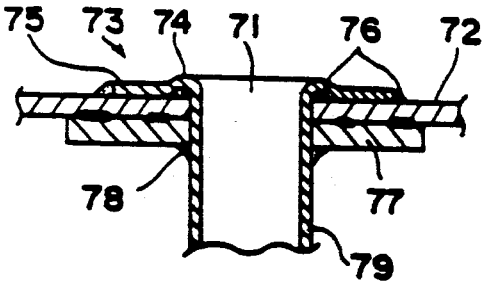
FIG. 9 is a longitudinal sectional view of further another embodiment of the joint formed between the flat tube and the header according to the method of the present invention.

In further another embodiment of the joint formed between the flat tubes and the headers of the heat exchanger shown in FIG. 9, the end portion 71 of the flat tube 79 is passed through the elliptical hole of the header 72. Then, the entire peripheral portion of the end portion 71 of the flat tube 79 extending upward from the header 72 is bent radially outwardly at substantially right angles to form an annular bent portion 73 provided with a small convex part 74 adjacent to a peripheral edge portion of the elliptical hole of the header 72. In the annular bent portion 73 of the flat tube 79: the small convex part 74 is integrally formed with a flat part 75 by which the small convex part 74 is surrounded as shown in FIG. 9.; and the flat part 75 is brought into an area contact with the surface or upper surface of the header 72. Adjacent to the flat part 75 are formed: brazed or soldered portions 76 for joining the flat tube 71 to the header 72. In addition, as shown in FIG. 9, a reinforcing plate 77 is fixedly mounted on a lower surface of the header 72, while provided with an elliptical hole. On the other hand, the elliptical hole of the reinforcing plate 77 is: aligned to the elliptical hole of the header 72; similar in both of size and shape to the elliptical hole of the header 72; and aligned with the elliptical hole of the header 72.

As is clear from FIG. 9, the end portion 71 of the flat tube 79 passing through the header 72 is also brazed or soldered to the reinforcing plate 77 through a brazed or soldered portion 78.

In the embodiment of the joint formed between the flat tube 79 and the header 72: the flat part 75 of the bent portion 73 of the flat tube 79 is brought into an area contact with the upper surface of the header 72 through a wide area; and the brazed or soldered portions 76 are formed in both of an area adjacent to a peripheral edge portion of the flat part 75 of the bent portion 73 and an area inside the small convex part 74 of the bent portion 73 of the flat tube 79. Consequently, the joint thus brazed or soldered and formed between the flat tube 79 and the header 72 had a sufficient strength.

In addition to the above, the header 72 is reinforced by fixedly mounting the reinforcing plate 77 on the lower surface of the header 72 to provide the end portion 71 of the flat tube 79 with a larger surface area contact with the header 72 and the reinforcing plate 77. This larger contact area established between the flat tube 79 and both of the header 72 and the reinforcing plate 77 makes the flat tube 79 more stable against an external force acting on the flat tube 79 in a direction perpendicular to the longitudinal axis of the flat tube 79.

The joint shown in FIG. 9 is constructed as follows: namely, the reinforcing plate 77 is fixedly mounted on the lower surface of the header 72 by welding and like processes before the end portion 71 of the flat tube 79 is passed through the elliptical hole of the header 72; then, the end portion 71 of the flat tube 79 is passed through the elliptical hole of the header 79 and the elliptical hole of the reinforcing plate 77 fixedly mounted on the lower surface of the header 72; the end portion 71 of the flat tube 79 is subjected to the bending operation to form the bent portion 73 consisting of the small convex part 74 and the annular flat part 75; and the thus bent portion 71 of the flat tube 79 is dipped into the molten filler metal bath together with the header 79 to form the joint between the flat tube 79 and the header 72, the joint being provided with the brazed or soldered portions 79, 78 shown in FIG. 9.

Figure 10:
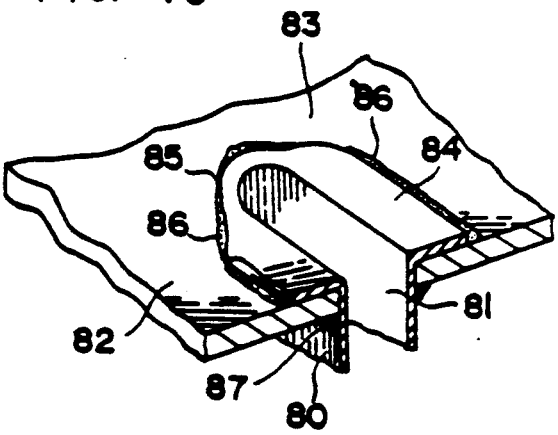
FIG. 10 is a perspective view of an essential part of still further another embodiment of the joint formed between the flat tube and the header according to the method of the present invention.
Figure 11:
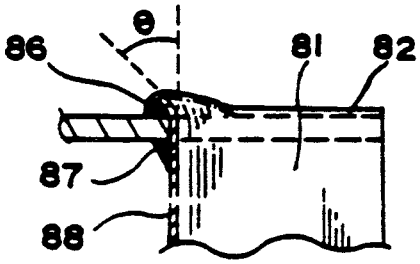
FIG. 11 is a longitudinal sectional view of an essential part of the joint, taken along the line X—X of FIG. 10.

FIGS. 10 and 11 show another embodiment of the joint formed between the flat tube 80 and the header 82, which joint is constructed as follows: first, the end portion 81 of the flat tube 80 is passed through the elliptical hole of the header 82, and then bent to form the bent portion 83 provided with the minor axis side walls 84 and the major axis side walls 85 each of which is smaller in width than each of the minor axis side walls 84 as is shown in FIG. 10 and extends upwardly in a direction deviated from the longitudinal axis of the flat tube 80 by an angle of $\ominus$, the bent portion 83 being brought into an area contact with the upper surface of the header 82.

The joint formed between the flat tube 80 and the header 82 is dipped into the molten filler metal bath to form the brazed or soldered portions 86 between the edge portion of the minor axis side walls 84 of the bent portion 83 of the flat tube 80 and header 82, and between the edge portion of the major axis side walls 85 and the header 82. During the brazing or soldering operation of the joint: a gap area between the major axis side walls 85 of the bent portion 83 of the flat tube 80 and the upper surface of the header 82 is filled with the filler metal as shown in FIG. 11; and an outer peripheral surface of the flat tube 80 is brazed or soldered to the lower surface of the header 82 through the brazed or soldered portion 87.

In the joint shown in FIGS. 10 and 11, the major axis side walls 85 extend upward in a direction deviated from the longitudinal axis of the flat tube 80 as described above to form the slopes extending from the upper surface of header 82 at an angle of preferably from 20° to 60°, and, therefore is not brought into an area contact with the upper surface of the header 82 in contrast with the minor axis side walls 44 brought into an area contact with the upper surface of the header 82, whereby it is possible to obtain the strong and safety bent portion 83 free from any crack, which bent portion 83 ensures to obtain the firm joint having a sufficient strength and reliability.

The joint shown in FIGS. 10 and 11 is constructed as follows: namely, in the substantially same manner as that described above with reference to FIG. 8, the shape of the bent portion 83 is realized by only employing a bending tool having a contour different from that of the bending tool 50 shown in FIG. 5; and, more particularly, for example, in the bending tool 50 shown in FIG. 5, by replacing the flat shoulder surface 51 with a straight or curved tapered surface a contour of which corresponds to the contour of the bent portion 83 of the flat tube 80.

Figure 12:
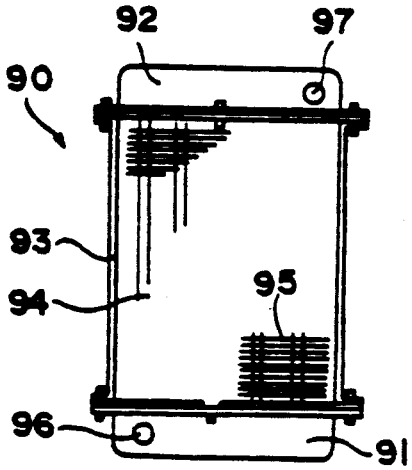
FIG. 12 is a front view of the entire heat exchanger unit provided with the radiator core constructed according to the method of the present invention.

FIG. 12 is a front view of an embodiment of the heat exchanger 90 comprising the cooling liquid tanks 91, 92 spaced apart from each other and the core which is interposed between the tanks 91, 92 and constructed of the flat tubes 94, air fins 95 and the headers. Opposite sides of each of the tanks 91, 92 are supported by a right and a left side member 93 through which the tank 91 is connected with the other tank 92. The flat tubes 94 interposed between the tanks 91 and 92 also serve as connecting means for connecting the tanks 91, 92 with each other. As is clear from FIG. 12, the air fins 95 are placed around the flat tubes 94 in the core of the heat exchanger 90. The tanks 91 and 92 are provided with a discharge opening 96 and an intake opening 97, respectively. Through the intake opening 97, the cooling liquid enters the tank 92, and is then passed through the flat tubes 94 while cooled by open air through the air fins 95 to reach the tank 91. The thus cooled cooling liquid having entered the tank 91 is discharged therefrom through the discharge opening 96 of the tank 91.

The method of the present invention for joining heat exchanger tubes with headers has the above construction. Consequently, the brazed or soldered joint formed between the flat tubes and the header in the core of the heat exchanger according to the method of the present invention has a sufficient strength and reliability to be able to stand large axial loads applied to the flat tubes of the heat exchanger. In addition, the brazed or soldered joint formed according to the method of the present invention is low in flow resistance of the cooling liquid passing therethrough in the core of the heat exchanger.

What is claimed is:

1. A method for joining a plurality of flat heat exchanger tubes with multiple headers of a heat exchanger, said flat tubes being formed with major and minor axis side walls, said major axis side walls being shorter in length and spaced further apart than said minor axis side walls, wherein each of said headers is provided with a plurality of elliptical holes through which each of said headers is joined with said flat tubes to form liquid-tight joints therebetween, a peripheral portion of each of said headers being joined with a flange portion of a tank body to form a tank for receiving a cooling liquid, which flows through said tubes, said method comprising the steps of:

obliquely cutting end portions of said major axis side walls of each of said plurality of flat tubes, to form trapezoidally shaped end portions of said minor axis side walls;

passing each of said end portions through corresponding ellipitical holes;

flaring each of said end portions;

bending radially outward said major and minor axis side walls of said end portions to form a bent portion which abuts each of said headers and has a relatively small width in a direction parallel to said major axis of a cross section of each of said flat tubes and a relatively large width in a direction parallel to said minor axis of said cross section of each of said flat tubes; and brazing or soldering said bent portions to said headers and brazing or soldering each of said plurality of flat tubes to said headers.

2. The method for joining the heat exchanger tube with the headers of the heat exchanger, as set forth in claim 1, wherein:

opposite sides of said trapezoidal shape of said minor axis side walls are straight.

3. The method for joining the heat exchanger tubes with the headers of the heat exchanger, as set forth in claim 1, wherein:

each of said bent portions is formed into a flat annular shape in a plane perpendicular to a longitudinal axis of said flat tubes, and brought into an area of contact with said header.

4. The method for joining the heat exchanger tubes with the headers of the heat exchanger, as set forth in claim 1, wherein:

each of said minor axis side walls is formed into a flat shape in a plane perpendicular to a longitudinal axis of said flat tube, and brought into an area of contact with said header; and each of said major axis side walls extends upward in a direction deviating from a longitudinal axis of said flat tube thereby preventing an area of contact with said header.

5. The method of joining the heat exchanger tubes with the headers of the heat exchanger, as set forth in claim 1, wherein:

an entire peripheral portion of each of said end portions is flared to form an annular bent portion on each of said plurality of flat tubes said annular bent portion being partially in contact with said header.

6. The method for joining the heat exchanger tubes with the headers of the heat exchanger, as set forth in claim 1, wherein:

opposite sides of said trapezoidal shape of said minor axis side walls are curved.

7. A method for joining a plurality of oval shaped heat exchanger tubes with multiple headers of a heat exchanger, each of said oval tubes being formed with side walls, each of said headers being provided with a plurality of elliptical holes through which each of said headers is joined with said oval tubes to form liquid-tight joints therebetween, a peripheral portion of each of said headers being joined with a flange portion of a tank body to form a tank for receiving a cooling liquid, which flows through said tubes, said method comprising the steps of:

cutting end portions of said side walls on each oval tube, wherein side walls at opposite ends of a major axis of the oval tube cross-section are shorter than side walls at opposite ends of a minor axis of the tube cross-section, passing each of said end portions through a corresponding one of said elliptical holes, bending radially outward said major and minor axis side walls to form a bent portion on each end portion which abuts each of said headers, and has a relatively small width in a direction parallel to said major axis of a cross section of each of said flat tubes and a relatively large width in a direction parallel to said minor axis of said cross section of each of said flat tubes, brazing or soldering each of said bent portions to each of said headers, and brazing or soldering each of said plurality of oval tubes directly to said headers.

* * * * *